US005123551A

United States Patent [19]

King

[11] Patent Number: 5,123,551

[45] Date of Patent: Jun. 23, 1992

[54] DISPENSING AND DISPLAY APPARATUS

[76] Inventor: Malcolm T. King, P.O. Box 5799, Gold Coast Main Centre, Queensland 4217, Australia

[21] Appl. No.: 536,617

[22] PCT Filed: Nov. 7, 1988

[86] PCT No.: PCT/AU88/00431

§ 371 Date: Jun. 3, 1990

§ 102(e) Date: Jun. 3, 1990

[87] PCT Pub. No.: WO89/04129

PCT Pub. Date: May 18, 1989

[30] Foreign Application Priority Data

| | | | |
|---|---|---|---|
| Nov. 5, 1987 | [AU] | Australia | PI5262 |
| Nov. 19, 1987 | [AU] | Australia | PI5512 |
| Jan. 12, 1988 | [AU] | Australia | PI6263 |
| Sep. 9, 1988 | [AU] | Australia | PJ0330 |

[51] Int. Cl.[5] ..... B65H 1/04

[52] U.S. Cl. ..... 221/34; 221/59; 221/155; 221/198; 221/279; 221/287

[58] Field of Search ..... 206/459; 221/34, 57, 221/58, 59, 60, 61, 155, 198, 226, 232, 279, 287

[56] References Cited

U.S. PATENT DOCUMENTS

| | | | |
|---|---|---|---|
| 1,968,013 | 7/1934 | Brownson | 312/50 |
| 2,152,174 | 3/1939 | Brunetti | 206/40 |
| 3,288,328 | 11/1966 | Longuyon | 221/232 X |
| 3,393,831 | 7/1968 | Stewart | 221/232 |
| 3,397,818 | 8/1968 | Rey | 221/232 |
| 3,860,304 | 1/1975 | Bolton | 312/71 |
| 4,039,080 | 8/1977 | Cappuccilli | 206/459 X |
| 4,045,102 | 8/1977 | Austin | 312/61 |
| 4,209,108 | 6/1980 | Winans | 221/6 |
| 4,285,443 | 8/1981 | Winans | 221/155 |
| 4,465,208 | 8/1984 | Buban et al. | 221/279 |
| 4,471,885 | 9/1984 | Mucciarone | 221/155 |
| 4,749,085 | 6/1988 | Denney | 206/459 X |
| 4,889,237 | 12/1989 | Brandon | 206/459 X |
| 4,968,037 | 11/1990 | Berry | 221/58 X |

FOREIGN PATENT DOCUMENTS

| | | |
|---|---|---|
| 17085/24 | 3/1924 | Australia . |
| 63450/80 | 4/1981 | Australia . |
| 1551122 | 12/1968 | France . |
| 2298990 | 8/1976 | France . |
| 2495915 | 6/1982 | France . |
| 2598307 | 11/1987 | France . |
| 1159858 | 7/1969 | United Kingdom . |
| 1285121 | 8/1972 | United Kingdom . |

*Primary Examiner*—Robert P. Olszewski
*Assistant Examiner*—Dean A. Reichard
*Attorney, Agent, or Firm*—Kimmel, Crowell & Weaver

[57] ABSTRACT

Dispensing apparatus for business cards or the like articles including a plurality of dispensing units which are in the form of hollow housings for receiving a stack of cards, each housing having a slot through which the cards are dispensed. The housings are supported on a grid-like support which is hingedly mounted to a backing board so that in one position access to the rear of the housings is prevented while in a second position access is allowed to permit refilling of the housings.

24 Claims, 6 Drawing Sheets

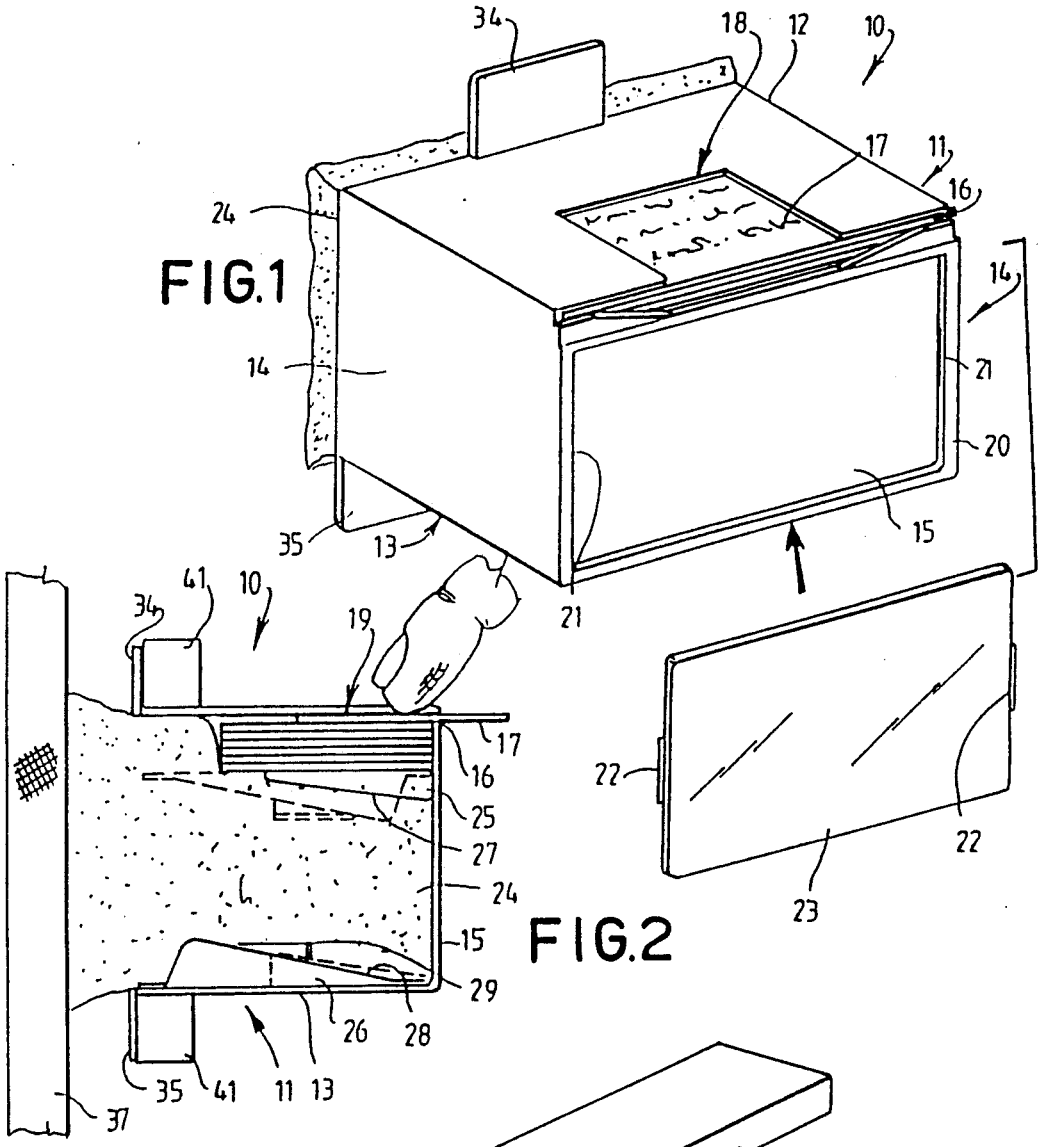
FIG.1
FIG.2
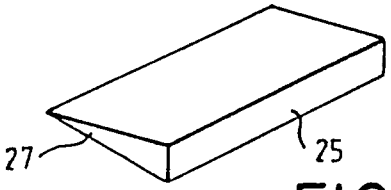
FIG. 3a
FIG. 3b.
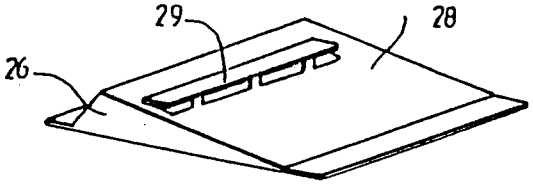

FIG.7
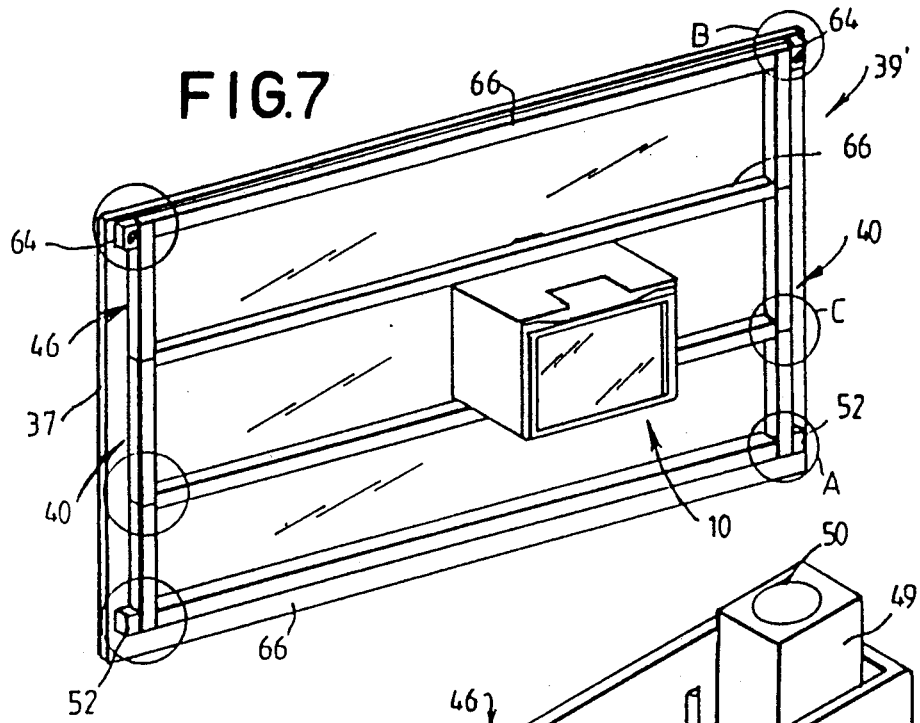
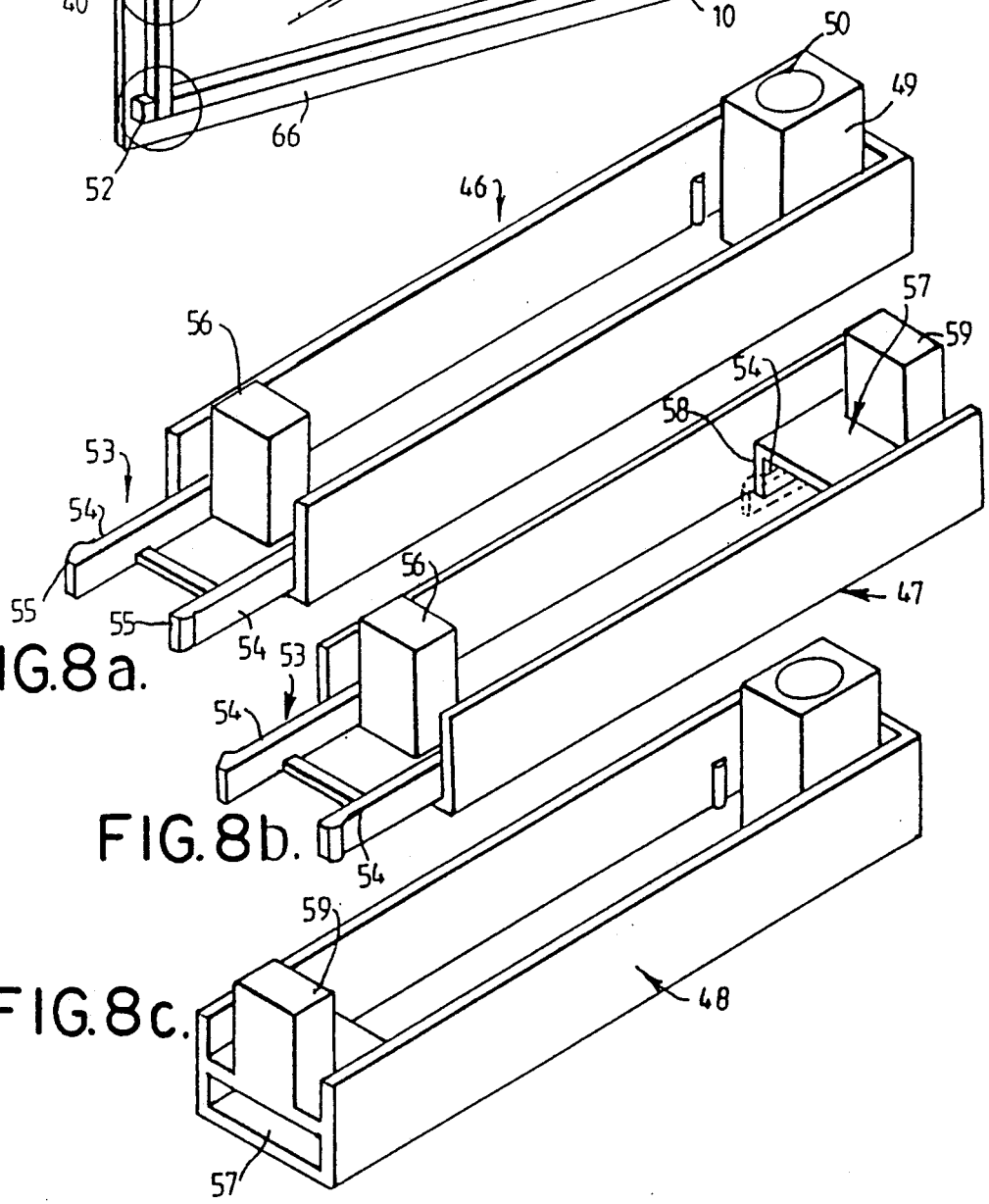
FIG.8a.
FIG.8b.
FIG.8c.

FIG. 9a
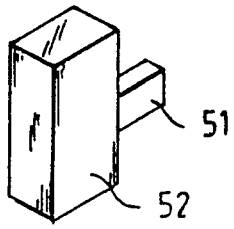
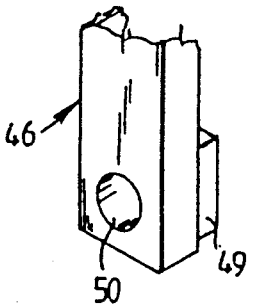
FIG. 9b
FIG. 10a
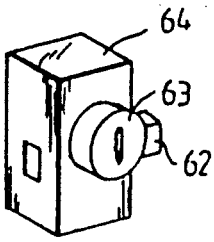
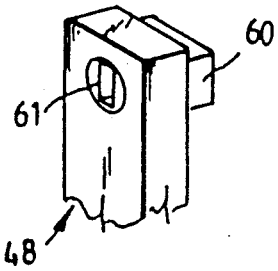
FIG. 10b
FIG. 11a.
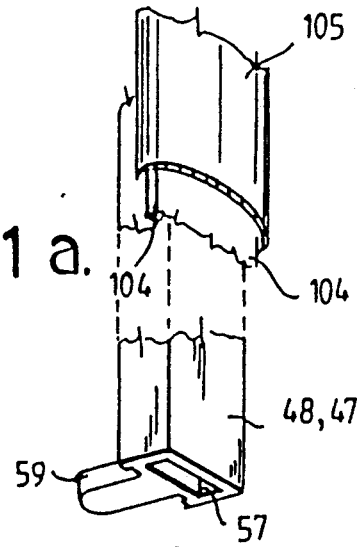
FIG. 11b.
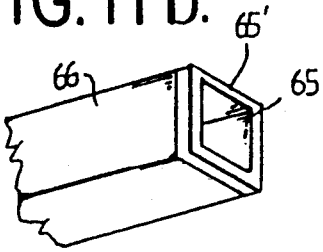
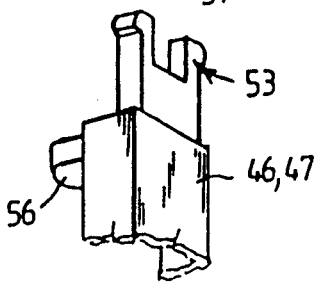
FIG. 11c

DISPENSING AND DISPLAY APPARATUS

TECHNICAL FIELD

THIS INVENTION relates to dispensing and display apparatus and in one aspect to apparatus for displaying and dispensing business or professional cards, brochures, pamphlets or other like articles. In a further aspect, the present invention relates to apparatus for displaying advertising material.

BACKGROUND ART

Many different forms of advertising are employed in commercial enterprises for business promotion purposes. Such forms of advertising may comprise posters, signs or other visible display means which are located in prominent positions, however, such display means are often subject to tampering or defacement so that the advertising effectiveness of such display means is lost or limited. Furthermore, the above forms of advertising are generally relatively expensive. In an alternative form of business promotion, business or professional cards are commonly used, however, such cards are normally only provided on request in a person to person situation and accordingly such cards do not generally provide an active form of advertising.

DISCLOSURE OF INVENTION

The present invention aims to provide apparatus which may be used to display business type cards, or other promotional or advertising material in public places for advertising purposes. The apparatus of the present invention may also include means for storing and dispensing business or professional cards, brochures or other similar generally planar articles. The present invention further preferably provides an arrangement for supporting a plurality of such dispensing means in a secure manner. Whilst the dispensing apparatus of the invention is particularly suitable for dispensing business cards, brochures or other like articles, it may also be used for displaying and /or dispensing other articles of a generally planar form.

With the above and other objects in view, the present invention provides in a first aspect apparatus for dispensing generally planar articles adapted to be arranged in a stack, said apparatus including generally hollow housing means adapted to support therein a said stack of articles, said housing means including slot means for the passage of respective said articles from one end of said stack therethrough, and biasing means adapted to be associated with said stack to urge respective said articles at said one end of said stack to a position to permit dispensing thereof through said slot means.

In one preferred form, the housing means comprises a generally rectangular housing adapted to neatly receive the stack of articles, and the slot means is provided in or defined by the front wall of the housing. Suitably, the slot means is provided adjacent a side wall for example a top or bottom wall of the casing and the biasing means is arranged to urge the stack of articles towards said side wall of the housing.

Preferably, the front wall of the housing terminates short of the side wall thereof to define the slot means. To facilitate dispensing of articles, the wall of the housing adjacent the slot is cut away to permit a finger or fingers of a user to engage the first article in the stack so as to facilitate displacement of the article from the stack and its movement through the slot means. Preferably, the slot means has, at least at the sides thereof, a width substantially the same or slightly greater than the thickness of an article to be dispensed so that only one article can be dispensed at any one time. The slot may also diverge in width away from the sides thereof.

In one form, the biasing means is in the form of spring biasing means and most preferably, the spring biasing means suitably comprise a pair of springs which extend between a pair of planar members which may be disposed between the stack of articles and the opposite wall of the housing to exert a biasing force on the stack of articles.

In a second form, the biasing means may comprise a block of resilient material such as foam plastics. In this form, first and second wedge shaped members may be provided in the housing between the stack of articles and the opposite wall of the housing so that the block of material is compressed in parallelism.

Suitably the rear side of the housing is open to allow loading of the articles and preferably at least the front and/or top wall are formed of transparent material to enable business cards, brochures or the like to be located thereagainst for advertising and identifying purposes. Alternatively, the front wall of the housing may be provided with a detachable lens or transparent member behind which an identifying card or brochure can be located.

The housing is also suitably provided with oppositely directed flanges on the rear side thereof which facilitate mounting thereof. Suitably the opposite flanges are complementary so as to permit interlocking with the flanges of adjacent upper or lower housings.

The present invention also provides in a further aspect support means for housings of the above type, said support means having at least one opening therein to accept a said housing and means for mounting said support means whereby to prevent access to the rear of said housing. Preferably, the flanges of the housing engage the support means on one side of the opening and the housing projects through to the opposite side of the opening. Suitably, the support means includes at least one pair of spaced apart members defining therebetween the opening.

The support means is suitably mounted relative to a base surface for movement between a first attitude preventing access to the rear of the housings and a second attitude permitting access to the rear of the housings for refilling thereof or replacement, addition or removal of respective housings. Most preferably, the support means as hingedly mounted to the base surface and may be locked in a position adjacent the base surface.

The support means is preferably constructed in the form of a grid including a plurality of parallel spaced apart frame members which extend between opposite side members. In one preferred form, the side members comprise a plurality of interconnected elements which coact at their points of interconnection to define spigots which extend into the opposite ends of the parallel members.

BRIEF DESCRIPTION OF THE DRAWINGS

In order that the invention may be more readily understood and put into practical effect, reference will now be made to the accompanying drawings which illustrate a preferred embodiment of the invention and wherein:

FIG. 1 is a perspective part exploded view of one form of dispensing unit according to the invention;

FIG. 2 is a sectional elevational view of the dispensing unit of FIG. 1 showing the dispensing of an article therefrom;

FIGS. 3*a* and 3*b* illustrate in perspective view, members for use in the unit of FIGS. 1 and 2 for assisting in dispensing of articles therefrom;

FIG. 7 illustrates a further dispensing assembly according to the invention;

FIGS. 8*a*, 8*b*, and 8*c* illustrate the components of the grid frame of the assembly of FIG. 7;

FIGS. 9*a* and 9*b* illustrate in exploded view the regions illustrated at A in FIG. 7;

FIGS. 10*a* and 10*b* illustrate in exploded view the regions illustrated at B in FIG. 7;

FIGS. 11*a*, 11*b* and 11*c* illustrate in exploded view the regions illustrated at C in FIG. 7;

BEST MODE FOR CARRYING OUT THE INVENTION

Figure 4:
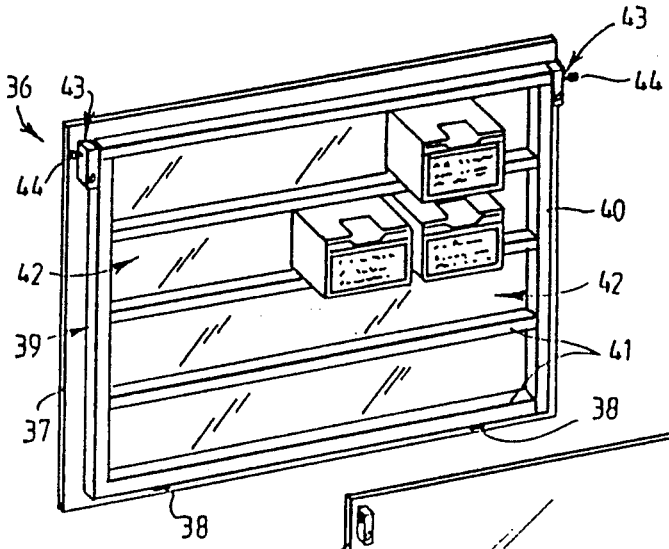
FIG. 4 illustrates a dispensing assembly including dispensing units according to the invention.

Referring to the drawings and firstly to FIGS. 1 and 2 there is illustrating a dispensing unit 10 according to the present invention comprising a hollow generally rectangular box-like casing 11 having top and bottom walls, 12 and 13 respectively, a pair of opposite side walls 14 and a front wall 15 which terminates at a position spaced from the top wall 12 to define a slot 16 therebetween for the passage of respective flat planar articles 17 therethrough.

The slot 16 at least at opposite sides of the front wall 15 is slightly wider than the thickness of a single planar article 17 so that only one such article may be dispensed at any one time. The top wall 12 of the unit 10 is provided with a central cut-out portion 18 which extends rearwardly from the leading edge of the wall 12 so that a digit or digits of the users hands may be inserted thereinto to engage the top article 17 of articles suitably arranged in a stack 19 and permit withdrawal of same in the manner shown in FIG. 2. The slot 16 as shown, preferably increases in width from adjacent each end towards a maximum width in the region of the centre of the wall 15 to facilitate dispensing of articles 17 which may have been deflected or arched downwardly due to excessive pressure being applied on the top article 17 in the stack 19.

The front wall 15 of the casing 11 is provided with an outwardly extending marginal portion 20 which is provided with opposite slots 21 for receipt of opposite tongues 22 of a transparent member or lens 23. This arrangement serves as a means for identifying the articles 17 which are to be dispensed with a single such article 17 being placed between the member 23 and front wall 15 so as to be viewable through the member 23. Alternatively, where the casing 11 is formed of transparent material, an article 17 may be simply placed rearwardly of the wall 15 and against the rear face thereof.

The casing 11 is open at its side opposite the front wall 15 so that articles 17 to be dispensed may be inserted in a stack 19 into the interior of the casing 11. Preferably, means are provided to urge the stack 19 towards the top wall 12 of the unit 10 and in one embodiment, such means comprise a block of resilient material suitably a block 24 of foamed plastics material. A wedge shaped member or driver 25 is disposed between the block 24 and the stack 19 of articles 17 and a further wedge shaped member or driver 26 is seated on the lower wall 13 of the unit 11 so that the block 24 is resiliently compressed between opposed walls 27 and 28 respectively of the drivers 25 and 26 which are substantially parallel to each other. The lower driver 26 also includes a forwardly extending raised abutment portion 29 which engages with the block 24 to prevent rearward movement thereof.

Figure 6:
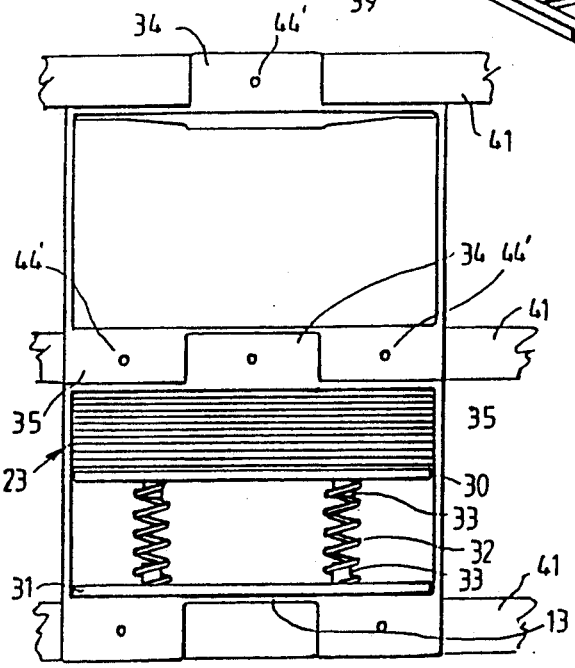
FIG. 6 is a rear view illustrating the interaction between a pair of dispensing units.

In an alternative arrangement shown in FIG. 6, the resilient block 24 is replaced by a spring biasing arrangement which comprises a pair of spaced planar members 30 and 31 which engage with the stack of articles 19 and bottom wall 13 respectively and which are biased apart by a pair of springs 32. The members 30 and 31 are provided with opposed spigots 33 over which the opposite ends of the springs 32 are engaged.

Either of the above biasing arrangements will ensure that the respective top articles 17 in the stack 19 will be urged towards the top wall 12 of the unit so as to permit withdrawal of the respective uppermost articles through the slot 16 whilst the appearance of the top driver 25 at the slot 16 will indicate that the dispensing unit 10 is empty.

For dispensing pamphlets or other similar material, the drivers 25 and 26 of the FIG. 2 embodiment are inverted and reversed as shown in dotted outline in FIG. 2 so that the driver 26 presents a substantially planar area for support of stacked pamphlets. In this arrangement, the portion 29 is directed rearwardly to engage with the block 24 whilst the driver 25 seats on the lower wall 13 of the dispenser unit 11.

The units 11 are also provided with an upper ear or flange 34 which extends upwardly from the rear of the top wall 12 and a pair of lower ears or flanges 35 which extend downwardly from the rear of the lower wall 13 and which are spaced apart a distance substantially the same as the width of the upper flange 34. The upper and lower flanges 34 and 35 facilitate mounting of the dispensing units 11 in a supporting grid and also serve to interlock adjacent upper and lower units 11 in the manner described below.

Figure 5:
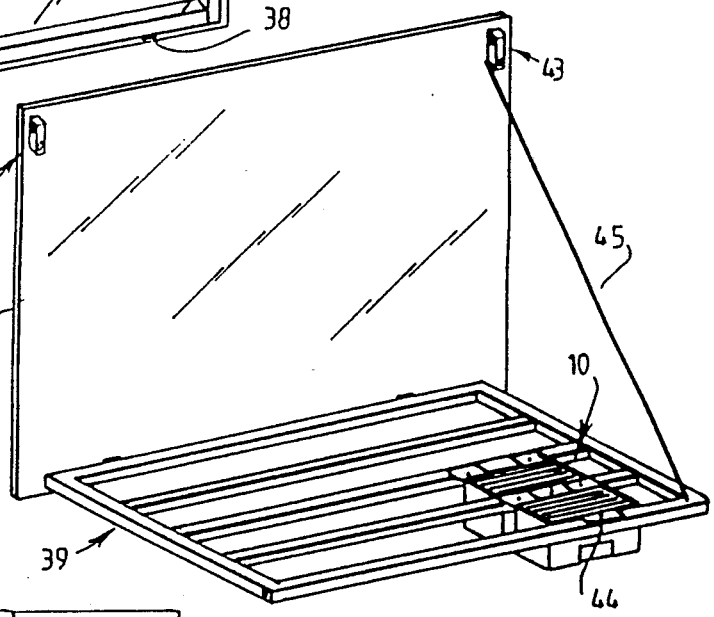
FIG. 5 illustrates the assembly of FIG. 4 in an attitude for replacement or refilling of the units.

Preferably a plurality of dispensing units 10 are adapted to be associated in use with a supporting assembly 36 of the type shown in FIGS. 4 and 5. This assembly 36 includes a backing board 37 which may be fixed say to a wall surface or comprise a wall surface or any other suitable mounting surface. Alternative, the board 37 may be supported on a stand. Hingedly mounted on the backing board 37 via a pair of hinges 38 is a grid-like frame 39 which includes a pair of side frame members 40 and a plurality of transverse frame members 41 connected at their opposite ends to the respective frame members 40 and extending therebetween. The frame members 41 extend substantially parallel to each other and are spaced apart so as to define elongated slots 42 of such a width as to neatly receive respective casings 11 therebetween as shown.

One or a pair of locking mechanisms 43 are mounted to the backing board 37 and include a key actuated locking pin 44 which is adapted for locking engagement with an aperture in the frame 39 so as to maintain the frame 39 in an operative attitude adjacent the backing board 37.

The respective casings 11 of the dispensing units 10 are arranged to extend through the slots 42 so that the dispensing slots 16 of the units 10 are externally accessible. As is apparent in FIG. 2, the upper and lower flanges 34 and 35 abut against respective frame members 41 on opposite sides of the slots 42 and are secured to respective adjacent frame members 41 by screws, clamps or other fasteners 44' (see FIGS. 5 and 6). Furthermore, the respective flanges 34 and 35 of adjacent upper and lower casings 11 are arranged to interlock in the manner shown in FIG. 6.

The units 10 may also be maintained securely in the frame 39 by means of the resilient blocks 24 which as shown in FIG. 2, are of a width greater than the width of the casings 11 so as to resiliently engage with the backing board 37. This will urge the casings 11 forwardly into firm engagement with the frame members 41 and substantially constrain the units 10 against movement. In this situation, the fasteners 44' are not required so that removal or replacement of dispensing units 10 is facilitated.

It will be apparent that when the frame 39 is in the position shown in FIG. 4 access to the rear of the casings 11 is blocked so that tampering with the contents is eliminated. When, however, the locking mechanism or mechanisms 43 are released, the frame 39 may be pivoted downwardly to the position shown in FIG. 5 where it may be supported by a cord, chain or other element 45 to permit access to the rear of the casings 11 for filling with further articles or for replacement, removal or addition of further units 10.

Preferably, the frame members 40 and 41 comprise hollow metal sections suitably aluminium sections which are welded together at their points of intersections. Alternatively the grid-like frame 39 may be constructed in the manner shown as 39' in FIGS. 7 to 11.

In this embodiment, the side frame portions 40 comprise a plurality of interconnected members 46, 47 and 48, details of which are shown more clearly in FIGS. 8 to 11. The members 46, 47 and 48 are of generally channel configuration and include cooperable interconnecting portions at their opposite end. In this regard, the member 46 includes an apertured block 49 at one end which defines a pivot aperture 50 adapted for pivotal engagement with a pivot post 51 supported on a mount 52 fixed to the backing board 37 (see FIG. 9). The opposite end of the member 46 is provided with a male connector 53 comprising a pair of resilient fingers 54 barbed at their free ends 55. The male connector 53 also includes an outwardly projecting tongue 56, the purpose of which hereinafter become apparent.

The member 47 is provided at one end with a male connector and tongue 53 and 56 of similar form to those on the member 46 and at its opposite end with a female socket 57 adapted to receive the male connector 53. The fingers 54 of the male connector 53 may be forced into the socket 57 so that the barbed ends 55 thereof locate behind a rearwardly directed wall 58 of the socket 56 so that the respective frame members 46 and 47 are securely interconnected. The member 47 also includes adjacent the socket 57 an outwardly projecting tongue 59 of similar form to the tongue 56 and these tongues become juxtaposed when the frame members are interconnected as above.

The member 48 includes at one end a female socket 57 of the same form as that on the member 47 for engagement with the male connector 53 on the member 47 and at its other end a block 60 which defines a rectangular aperture 61 for engagement by a locking member 62 (see FIG. 10). The locking member 62 is associated with a barrel lock 63 supported in a mount 64 fixed to the backing board 37 and may be moved into and out of engagement with the aperture 61 by insertion of a key into the lock 63 and rotation of same in opposite directions.

At the points of interconnection between the respective members 46, 47 and 48, pairs of outwardly projecting tongues 56 and 59 are juxtaposed to define spigots which are arranged to extend into a socket 65 defined in an end of a hollow transverse frame member 66, the socket 65 preferably being formed in an end plug 65' inserted into the end of the member 66. Alternatively, the member 66 being hollow may simply define the socket 65 in itself. This engagement between the end plugs 65' and tongues 56 and 59 also serves to maintain the members 46, 47 and 86 in secure engagement as these members cannot be disconnected until the members 66 are first detached.

At the "pivot end" and "lock end" of the frame 39', the socket plugs 65' of the members 66 engage with the blocks 56 and 59 respectively which are sized to locate neatly therein. It will be apparent that the grid-like frame 39' assembled with the components 46, 47, 48 and 66 may be pivoted about the pivot posts 51 or locked to the board 37 by means of the locking mounts 64 to retain the dispensing units 10 in a similar manner to that shown in FIGS. 5 and 7.

The members 46, 47 and 48 may of course be constructed in many different configurations and the male and female interconnecting parts of the members may be arranged in opposite dispositions if required. It will also be apparent that the whole grid 39' may be simply disassembled into the separate component parts to permit easy transportation to a desired erection site. Furthermore, the size of the frame lengthwise may be simply varied by varying the length of the members 66 whilst for greater widths, further intermediate elements 47 may be employed between the elements 46 and 48.

Figure 12:
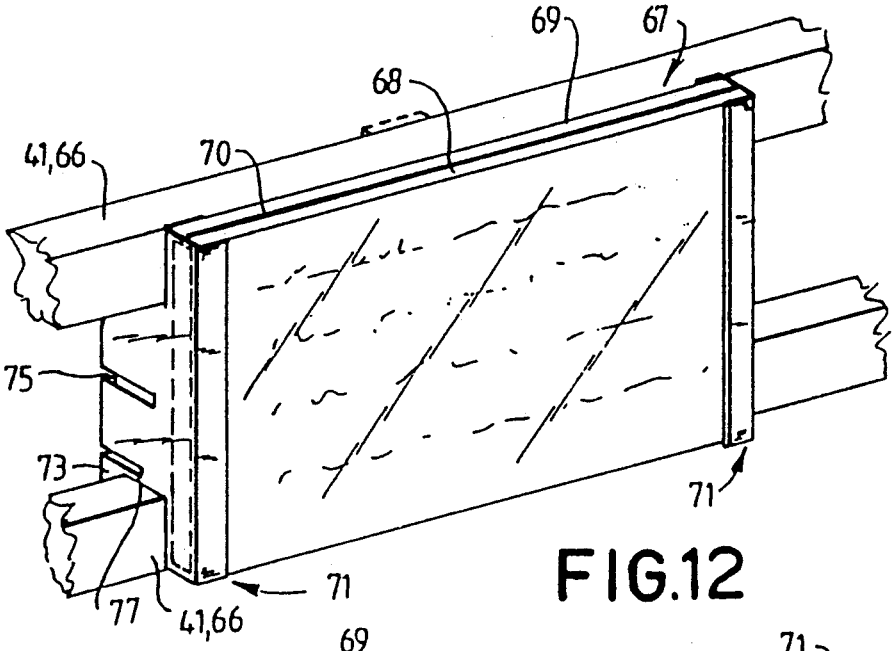
FIG. 12 illustrates an alternative display unit for use in the assembly of FIG. 4 or FIG. 7.
Figure 13A:
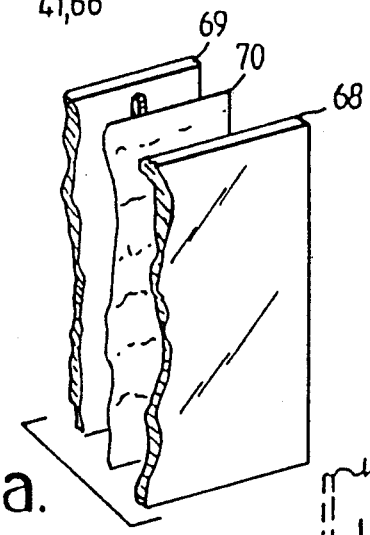
FIG. 13*a* is an exploded view of the sign components of the display unit of FIG. 12.
Figure 13B:
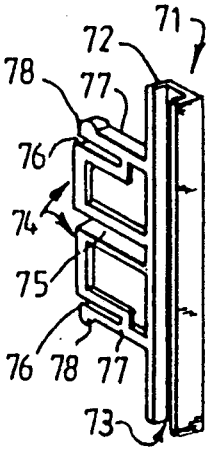
FIG. 13*b* is a view of an end bracket of the display unit of FIG. 12.
Figure 13C:
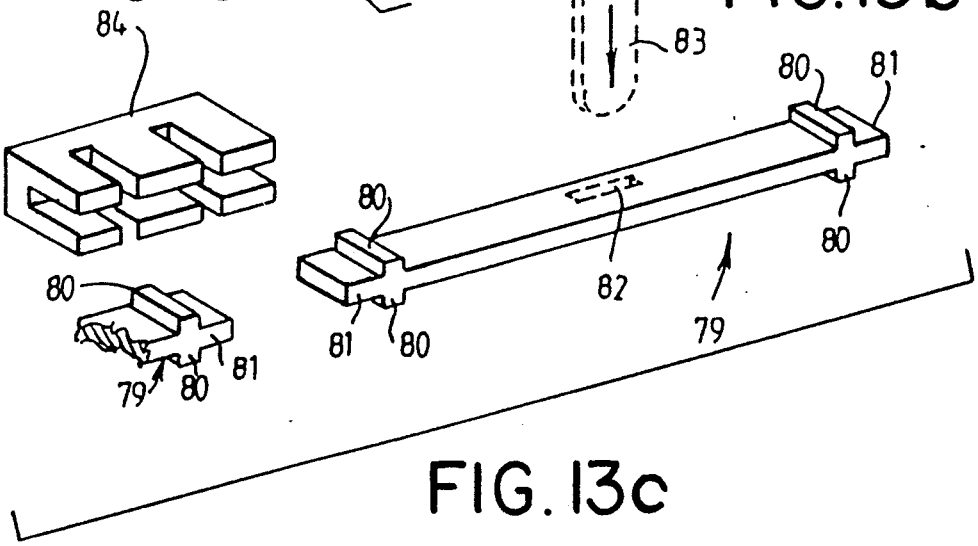
FIG. 13*c* is an exploded view illustrating the components at the rear of the display unit of FIG. 12.

FIGS. 12 and 13 illustrate a further form of display apparatus 67 according to the invention which is adapted to be associated with the grid-like frames 39 or 39' of the type shown in FIGS. 4 or 7. In this embodiment, the display apparatus 67 includes a pair of planar members 68 and 69 at least the front one 68 of which is formed of a transparent material such as clear acrylic or other plastics material and which are adapted to sandwich therebetween an advertising sign 70 which may simply comprise a sheet of material such as paper or cardboard printed with the desired message to be advertised.

The members 68 and 69 are adapted to be supported in juxtaposed attitude sandwiching the sign 70 therebetween by a pair of end supports 71 each of which includes an elongated body portion 72 which defines a channel 73 to accept end portions of the members 68 and 69 and a pair of spaced apart tongues 74 which extend rearwardly from the body portion 72. As shown, the tongues 74 are spaced apart to define a slot 75 therebetween for a purpose which will hereinafter become apparent.

The tongues 74 are also slotted at 76 to define resilient fingers 77 having enlarged outer head portions 78. This will permit the tongues 74 to be forced between the frame members 41 (or 66) with the fingers 77 deflecting resiliently inwardly until the headed end portions 78 pass beyond the rear of the members 41 (or 66) and spring outwardly to retain the supports 71 in position.

The members 68 and 69 may thus be assembled with the sign 70 therebetween and engaged at opposite ends with the channels 73 of the respective supports 71, the tongues 74 of the latter then being forced between respective pairs of frame members 41 or 66, to secure the sign in position as shown in FIG. 12.

An elongated spacing member 79 may be provided to maintain the supports 71 at a fixed spacing, each spacing member 79 including a pair of opposite abutment members 80 at opposite ends. The opposite projecting ends 81 of the member 79 may thus be inserted into the slots 75 in the spaced supports 71 to frictionally engage same and maintain the supports 71 in a set spacing. The member 79 may also be centrally apertured at 82 to receive a retaining member 83, the latter being disposed rearwardly of and spanning respective frame members 41 or 66 (see FIG. 12).

The members 79 are made of a length to match the length of the planar members 68 and 69, however, for extended lengths, a joining member 84 is provided to engage over the abutments 80 of respective adjacent members 79 to interconnect same in an end-to-end relationship.

In an alternative configuration of supports, the fingers 77 may be eliminated and stop means engaged with the tongues 74 rearwardly of the frame members 41 or 66 to prevent detachment of the supports 71. Such stop means may comprise O-rings disposed about the tongues to present an abutment to the frame members 41 or 66. If desired, the rear planar members 69 may be apertured to prevent or reduce condensation between the members 6B and 69 and thus damage to the sign 70.

Figure 14:
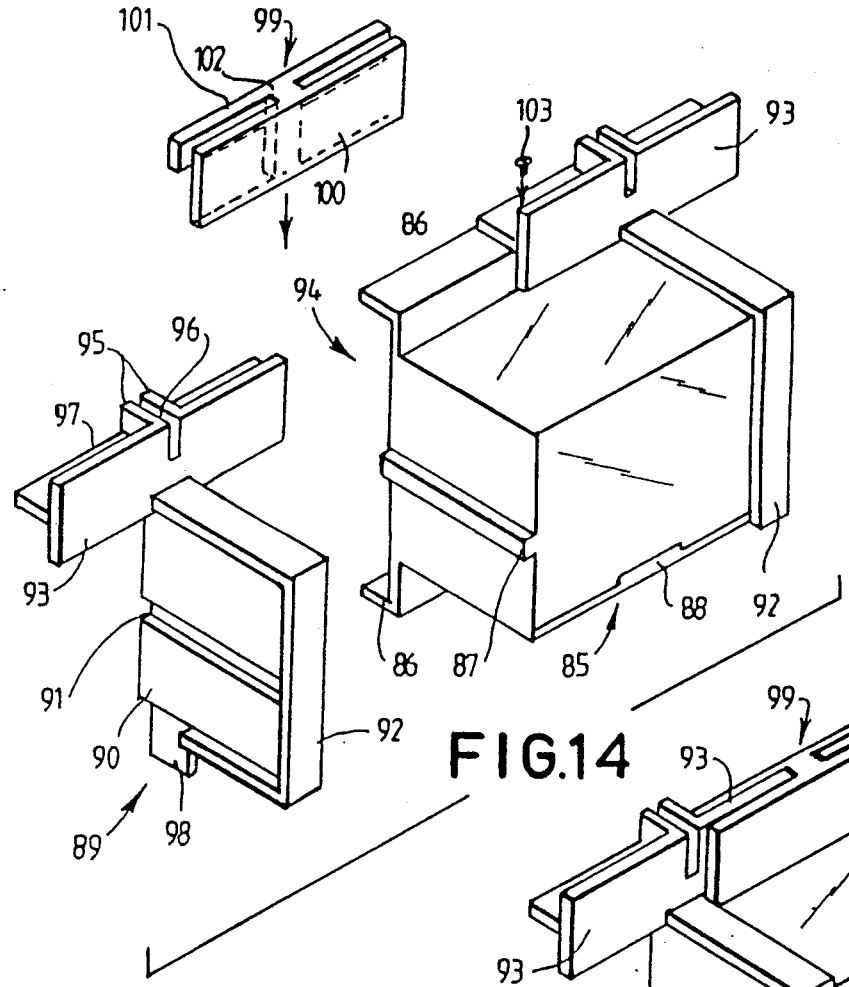
FIG. 14 is an exploded view of an alternative dispensing system according to the invention.
Figure 15:
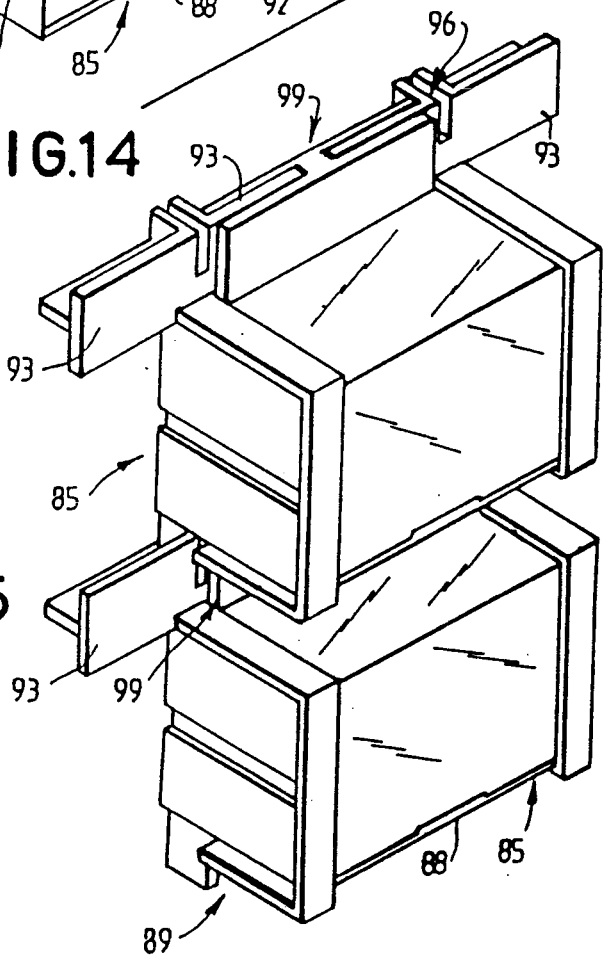
FIG. 15 illustrates the manner of interconnection of a pair of units according to FIG. 14.

FIGS. 14 and 15 illustrate an alternative dispensing system according to the present invention. In this embodiment, the dispensing units 85 are of similar form to that shown in FIG. 1 however in this case right-angled flange portions 86 are provided in place of the upper and lower flanges 34 and 35. The units 85 also include on their side walls raised ribs 87 which extend rearwardly from the front wall of each unit 85. The dispensing slots 88 in this embodiment are disposed on the lower side of the dispenser however they also may be arranged as shown in FIG. 1. Similarly, the dispensing slots 16 of FIG. 1 may be arranged as shown in FIG. 14.

The support arrangement in this embodiment includes for each dispensing unit 85 a pair of opposite side support brackets 89 each of which includes a generally planar wall 90 which is provided with slots or grooves 91 in its opposite sides to accept respective ribs 87 of the dispensing units 85 suitably in a slidable fashion. A flange 92 extends about three sides of the wall 90 so as to in use engage the top, bottom and front walls of the dispensing unit 85. Each, bracket 89 also includes a top elongated flange member 93 which extends substantially normal to the wall 90 and is centrally slotted at 94 whilst a pair of wall members 95 extend rearwardly from the slot 94 to define a groove 96 the purpose of which will hereinafter become apparent. A further wall or flange 97 extends rearwardly at right angles from the top flange member 93 whilst the bracket 89 also includes a tongue 98 which is sized for receipt in the groove 96 of a further bracket 89.

The support arrangement for the dispensers 85 also includes a generally H-shaped connecting member 99 adapted to interconnect a pair of adjacent brackets 89. The connecting member 99 includes a front wall member 100 and a parallel rear wall member 101 of reduced height interconnected by a spacer 102 which spaces the front and rear wall members 101 and 100 apart a distance substantially the same as the width of the wall members 93.

In use a pair of brackets 89 are engaged with a dispenser 85 by slidably or otherwise engaging the ribs 87 with the grooves 91 and so that the flange 92 is located adjacent to the top, bottom and front walls of the dispenser 85 and the respective flanges or wall members 93 and 97 contiguous with adjacent faces of the flange portion 86. If desired, fasteners 103 may be used to secure the flanges 97 to the flange portions 86 to positively secure the brackets 89 to the dispensers 85. A connecting member 99 is then engaged over the respective flange members 93 of the adjacent brackets 89 so that the members 93 are located between the respective wall members 100 and 101 of the connecting member 99 as shown in FIG. 15.

Where a plurality of dispensers 85 are to be used, they may be arranged side-by-side with respective brackets 89 being interconnected by respective connecting members 99. Where a plurality of dispensers 85 are to be arranged one above the other as shown in FIG. 15, the tongues 98 of the upper brackets 89 are received within the slots 96 of the lower brackets 89 and in this arrangement, the bracket flanges 97 will be sandwiched between the flange portions 86 of the upper and lower dispensers 85 and may be secured thereto again by fasteners 103.

The brackets 89 may be mounted to a suitable surface or in a suitable frame to allow if desired access from the rear for refilling the dispensers 85 and of course any number of dispensers 85 may be assembled together by providing the appropriate number of brackets 89 and connecting members 99.

It will be apparent that each of the above described embodiments will provide an efficient means for dispensing advertising material such as business cards as well as a displaying such material. Many variations and modifications of course could be made to the embodiments without departing from the broad ambit of the invention. For example, the frames 39 or 39' may be mounted for slidable movement to a backing board or other base surface or alternatively mounted for pivotal movement about a vertical axis. Furthermore, any number of frames 39 or 39' may be provided and in one arrangement, a pair of adjacent frames may be mounted for pivotal movement about spaced vertical axes with the frames coacting in their operative attitude as in a pair of gates. For this purpose, one frame may be provided with a lug or other member which engages the other frame when in the operative attitude so that a single locking means applied to the one frame will maintain both frames in their operative attitude.

Other forms of biasing means such a weights or leaf springs may be provided for applying a loading to the stack of articles and whilst the dispensing units are preferably formed of a plastics material, they may be formed of metal. Similarly the other components of the system may be formed of metal or plastics materials.

In an alternative arrangement of display device shown in FIG. 12, the channel part 72 may be slotted in its base as shown in dotted outline to accept the ends of the members 69 and 70. This will ensure a more rigid and stable connection between the members 69 and 70 and the supports 71.

In a further modification to the embodiment of FIG. 7 and so as to increase the rigidity of the supporting grid frame 39', the members 46, 47 and 48 may be provided with opposite ribs or flanges 104 engageable by a stiffening strip formed say of aluminium in the manner illustrated in FIG. 11. Alternatively, a stiffening member or members may be located internally of the members 46, 47 and 48 to extend longitudinally thereof. Other arrangements of locking devices may also be provided to secure the frames 39 or 39' in their operative attitude. For example a single locking device may be provided centrally on the board 37 to lockingly maintain the frames in the upright attitude.

I claim:

1. Dispensing apparatus including at least one dispenser for dispensing generally planar articles adapted to be arranged in a stack, said dispenser including generally hollow housing means adapted to support therein said stack of articles, said housing means including slot means for the passage of respective said articles from one end of said stack therethrough, biasing means adapted to be associated with said stack to urge respective said articles at said one end of said stack to a position to permit dispensing thereof through said slot means, and support means for supporting said at least one dispenser, said support means for supporting said at least one dispenser, said support means having at least one opening therein for accepting said at least one dispenser, said support means including a plurality of parallel spaced apart members extending between opposite side members to define a supporting grid, said supporting grid defining said at least one opening, said side members comprising a plurality of interconnected elements, said elements coating at their points of interconnection to define spigots for engagement by said parallel members.

2. Apparatus according to claim 1 wherein said housing means comprises a generally rectangular housing adapted to receive said stack of articles, and said slot means is provided in or is defined by a front wall of the housing.

3. Apparatus according to claim 2 wherein said front wall of said housing terminates short of a side wall of said housing to define said slot means.

4. Apparatus according to claim 3 wherein said side wall is cut away to permit a finger or fingers of a user to engage the first article in said stack so as to facilitate displacement thereof from said stack and its movement through said slot means.

5. Apparatus according to claim 4 wherein said slot means has, at least at the sides thereof, a width substantially the same as the thickness of said article to be dispensed whereby only one said article can be dispensed at any one time.

6. Apparatus according to claim 1 wherein said biasing means comprises a pair of members disposed between said stack of articles and an adjacent wall of said housing and spring means for urging said members apart.

7. Apparatus according to claim 1 wherein said biasing means comprises a block of resilient material.

8. Apparatus according to claim 1 and including means for mounting said supporting grid relative to a backing whereby to prevent access to the rear of said dispenser housing means.

9. Apparatus according to claim 8 wherein said supporting grid is mounted for movement relative to said backing between a first attitude preventing access to the rear of said dispenser housing means and a second attitude permitting access to the rear of said housing means for refilling thereof.

10. Apparatus according to claim 9 wherein said supporting grid is hingedly mounted relative to said backing and there being provided locking means for selectively locking said supporting grid in said first attitude.

11. Dispensing apparatus including at least one dispenser for dispensing generally planar articles adapted to be arranged in a stack, said dispenser including generally hollow housing means adapted to support therein said stack of articles, said housing means including slot means for the passage of respective said articles from one end of said stack therethrough, biasing means adapted to be associated with said stack to urge respective said articles at said one end of said stack to a position to permit dispensing thereof through said slot means, said support means for supporting said at least one dispenser, said support means having at least one opening therein for accepting said at least one dispenser, said support means including a plurality of parallel spaced apart members extending between opposite side members to define a supporting grid, said support grid defining between said members said at least one opening, said side members comprising plurality of interconnected elements, said elements coacting at their points of interconnection to define spigots for engagement by said parallel members, said supporting grid being hingedly mounted relative to a backing for movement between a first attitude preventing access to the rear of said housing means and a second attitude permitting access to the rear of said housing means for refilling thereof, and there being provided locking means for locking said support means in said first attitude.

12. Dispensing apparatus including at least one dispenser for dispensing generally planar articles adapted to be arranged in a stack, said dispenser including generally hollow housing means adapted to support therein said stack of articles, said housing means including slot means for the passage of respective said articles from one end of said stack therethrough, biasing means adapted to be associated with said stack to urge respective said articles at said one end of said stack to a position to permit dispensing thereof through said slot means, and support means for supporting said at least one dispenser, said support means having at least one opening therein for accepting said at least one dispenser, said dispenser including abutment means engaging said support means on one side of said opening and projecting through said support means to the other side of said opening, and means for mounting said support means relative to a backing for movement between a first position wherein access to the rear of said housing means is prevented and a second position permitting access to the rear of said housing means for refilling thereof.

13. Dispensing apparatus according to claim 12 wherein said biasing means comprises a block of resilient material, said resilient material being sandwiched between said housing means and said backing when said support means is in said first position whereby to resiliently urge said abutment means of said housing means into engagement with said support means.

14. Dispensing apparatus according to claim 12 wherein said support means includes at least one pair of spaced apart parallel members extending between opposite side members to define a supporting grid, said supporting grid defining between said members said at least one opening.

15. Dispensing apparatus according to claim 14 wherein said side members comprise a plurality of interconnected elements, said elements coacting at their points of interconnection to define spigots for engagement by said parallel members.

16. Dispensing apparatus according to claim 12 wherein said support means is hingedly mounted for movement relative to said backing.

17. Dispensing apparatus according to claim 12 wherein said housing means comprises a generally rectangular housing adapted to receive said stack of articles, and said slot means is provided adjacent a forward edge of said housing means.

18. Dispensing apparatus according to claim 17 wherein said housing means includes a front wall and side walls and wherein said slot means is provided at the junction of said front wall and one said side wall.

19. Dispensing apparatus according to claim 18 wherein at least one of said front wall and said side wall forming said slot means is cut away or recessed adjacent said slot means to permit a finger or fingers of a user to engage the first article in said stack so as to facilitate displacement thereof from said stack and its movement through said slot means.

20. Dispensing apparatus according to claim 12 wherein said slot means has, at least at its opposite ends, a width substantially the same as the thickness of said article to be dispensed whereby to prevent or retard the dispensing of more than one article therethrough at any one time.

21. Dispensing apparatus according to claim 12 wherein said biasing means comprises a pair of members disposed between said stack of articles and an adjacent wall of said housing means and spring means for urging said members apart.

22. Dispensing apparatus according to claim 21 wherein said members include spigots for receiving opposite ends of said spring means.

23. Dispensing apparatus according to claim 12 wherein said housing means includes at least a transparent front face so as to enable a said planar article disposed rearwardly thereof to be viewed.

24. Apparatus according to claim 12 wherein said housing means is provided with an opening at the rear thereof to permit placement of said articles therein.

* * * * *